US006386005B1

(12) United States Patent
Kuo

(10) Patent No.: US 6,386,005 B1
(45) Date of Patent: May 14, 2002

(54) COMBINATION LOCK

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/841,028

(22) Filed: Apr. 24, 2001

(51) Int. Cl.[7] ..... E05B 37/06
(52) U.S. Cl. ..... 70/28; 70/30; 70/312; 70/316; 70/324
(58) Field of Search ..... 70/22, 27, 28, 70/30, 312, 315–317, 324

(56) References Cited

U.S. PATENT DOCUMENTS 4,896,517 A * 1/1990 Ling ..... 70/18
5,142,888 A * 9/1992 Ling ..... 70/312 X
5,193,367 A * 3/1993 Ling ..... 70/312 X
5,787,736 A * 8/1998 Ling ..... 70/312 X
5,899,099 A * 5/1999 Tsai ..... 70/312 X
5,924,313 A * 7/1999 Kuo ..... 70/312 X
5,934,120 A * 8/1999 Kuo ..... 70/312
6,209,368 B1 * 4/2001 Lee ..... 70/312

FOREIGN PATENT DOCUMENTS

DE 3410047 * 10/1985 ..... 70/312

* cited by examiner

*Primary Examiner*—Lloyd A. Gall
(74) *Attorney, Agent, or Firm*—Jackson Walker L.L.P.

(57) ABSTRACT

A combination lock has a plug with a tube extending from the plug. Multiple combination ring assemblies are disposed around the tube, and each of the combination ring assemblies include a combination ring, a positioning ring, and an abutting ring. A bar is inserted with an end inside the tube and an opposed end mounted with a nut extending outside the tube. A cap having a chamber inside is received in a cover, and the nut is received in the chamber. When changing a combination number of the combination lock, a tool is used to turn the cap to separate the combination ring and the positioning ring thus allows the combination number to be changed, and when the changing is completed, the cap is turned to a original position and the combination ring and the positioning ring engages together automatically.

4 Claims, 6 Drawing Sheets

COMBINATION LOCK

BACKGROUND OF THE INVENTION

1. Field of the Invention

The present invention relates to a combination lock, and more particularly to a combination lock whose combination can be reset or changed easily.

2. Description of Related Art

There are many combination locks currently available in which the combination can be changed. However, these locks usually have a complex structure that is not easy and convenient to manufacture and assemble. Moreover, the combination may be accidentally changed in use such that even the owner does not know the resultant combination, and the combination lock is consequently useless.

Therefore, an objective of the invention is to provide a combination lock to mitigate and/or obviate the aforementioned problems.

SUMMARY OF THE INVENTION

The main objective of the present invention is to provide a combination lock, such that the combination of the combination lock can be changed.

Another objective of the present invention is to provide a combination lock, such that the combination is prevented from being accidentally changed.

Another objective of the present invention is to provide a combination lock, such that dust is prevented from entering the combination lock when changing the combination.

Other objectives, advantages and novel features of the invention will become more apparent from the following detailed description when taken in. conjunction with the accompanying drawings.

DETAILED DESCRIPTION OF THE PREFERRED EMBODIMENT

Figure 1:
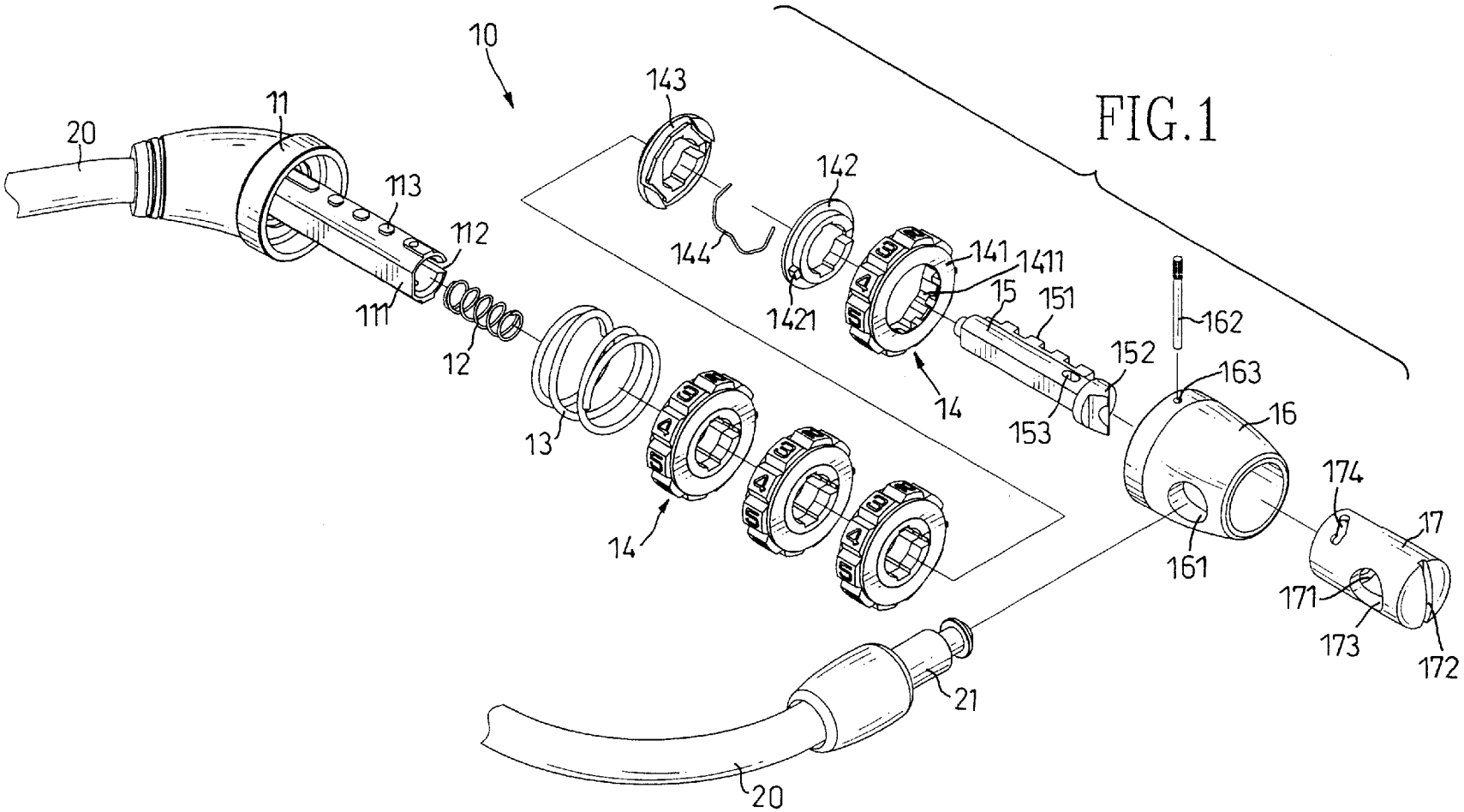
FIG. 1 is an exploded, perspective view of a combination lock in accordance with the present invention.

With reference to FIG. 1, a combination lock in accordance with the present invention includes a body (10) and a cable (20). The body (10) further includes a cable connector (11), multiple combination ring assemblies (14), a locking bar (15), a cover (16) and a plug (17).

The cable connector (11) has a hollow combination ring shaft (111) with an inner and an outer surface extending outward centrally from the cable connector (11). A longitudinal slot (112) is defined in the combination ring shaft (111) and multiple nubs (113) are formed on and protrude from the outer surface of the combination ring shaft (111). An inner spring (12) is inserted inside the combination ring shaft (111), and an outer spring (13) is mounted around the combination ring shaft (111). Both the inner and the outer springs (12 and 13) abut the cable connector (11).

Each of the combination ring assemblies (14) has a combination ring (141), a positioning ring (142) and an abutting ring (143). The combination ring (141) has an outer face and an inner surface. Numbers are formed on the outer face, and multiple detents (1411) are defined on the inner surface. Each detent (1411) corresponds to one of the numbers on the outer face. A positioning ring (142) with a protuberance (1421) configured to correspond to the detent (1411) is concentrically mounted in and on one side of the combination ring (141). An abutting ring (143) is mounted next to and concentric with the positioning ring (142) with a hairspring (144) clamped between the positioning and the abutting rings(142, 143).

The locking bar (15) has two ends with one end inserted inside the combination ring shaft (111) and abutting and compressing the inner spring (12). knife-edge latch (152) is formed on the opposite end and extends outside the combination ring shaft (111). Multiple teeth (151) are formed on the locking bar (15) such that the teeth (151) can be received in the slot (12). A pin slot (153) is defined in the locking bar (15) near the knife-edge latch (152).

The cover (16) is a tapered hollow cylinder with an outer surface, an inner surface, a large end, a small end and a first radial through hole (161) defined through the outer surface of the cover (16). A pin hole (163) is defined in the outer surface of the large end of the cover (16) to allow a pin (162) to extend through the cover (16).

The plug (17) is a hollow cylinder with one closed end and an open end. The closed end has an outer surface and an inner surface. A screw slot (172) is defined on the outer surface of the closed end, and a chamber (171) is defined inside the plug (17). A second radial through hole (173) is defined in a periphery of the plug (17) to correspond to and align with the first radial through hole (161) in the cover (16) and communicate with the chamber (171). A skewed guided slot (174) is also defined in the periphery of the plug (17) to allow the pin (162) to extend through and slide in the skewed guide slot (174).

The cable (20) has two ends. One end of the cable is securely attached to the cable connector (11), and the other end is connected to a locking stub (21). The locking stub (21) is configured to be able to extend through the first radial through hole (161), the second radial through hole (173) and into the chamber (171). The stub (21) has a flange formed at a free end of the stub (21) to engage with the knife-edge latch (152) in the locking bar (15).

Figure 2:
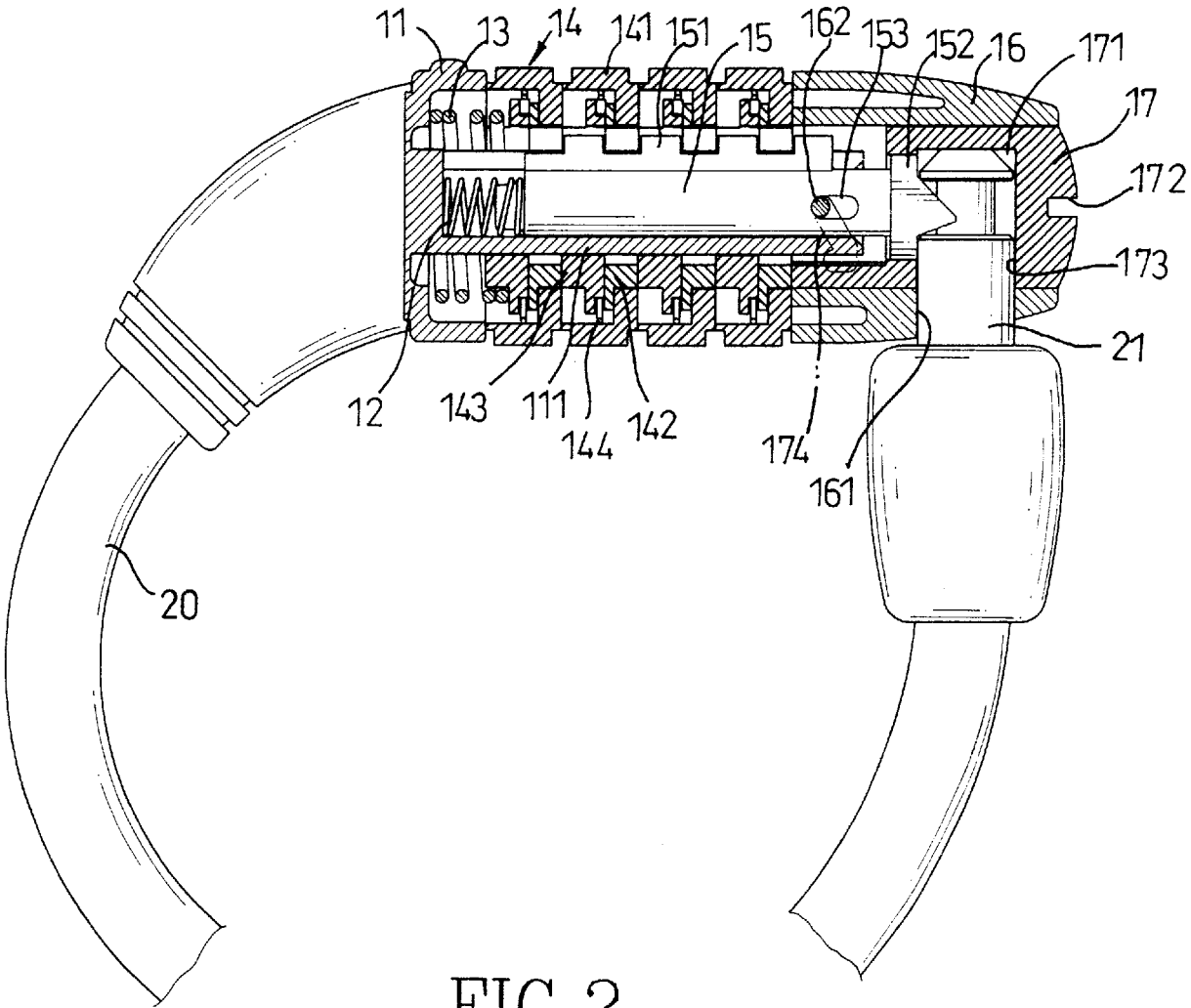
FIG. 2 is a top plan view in partial section of the combination lock with the stub received in the body.
Figure 3:
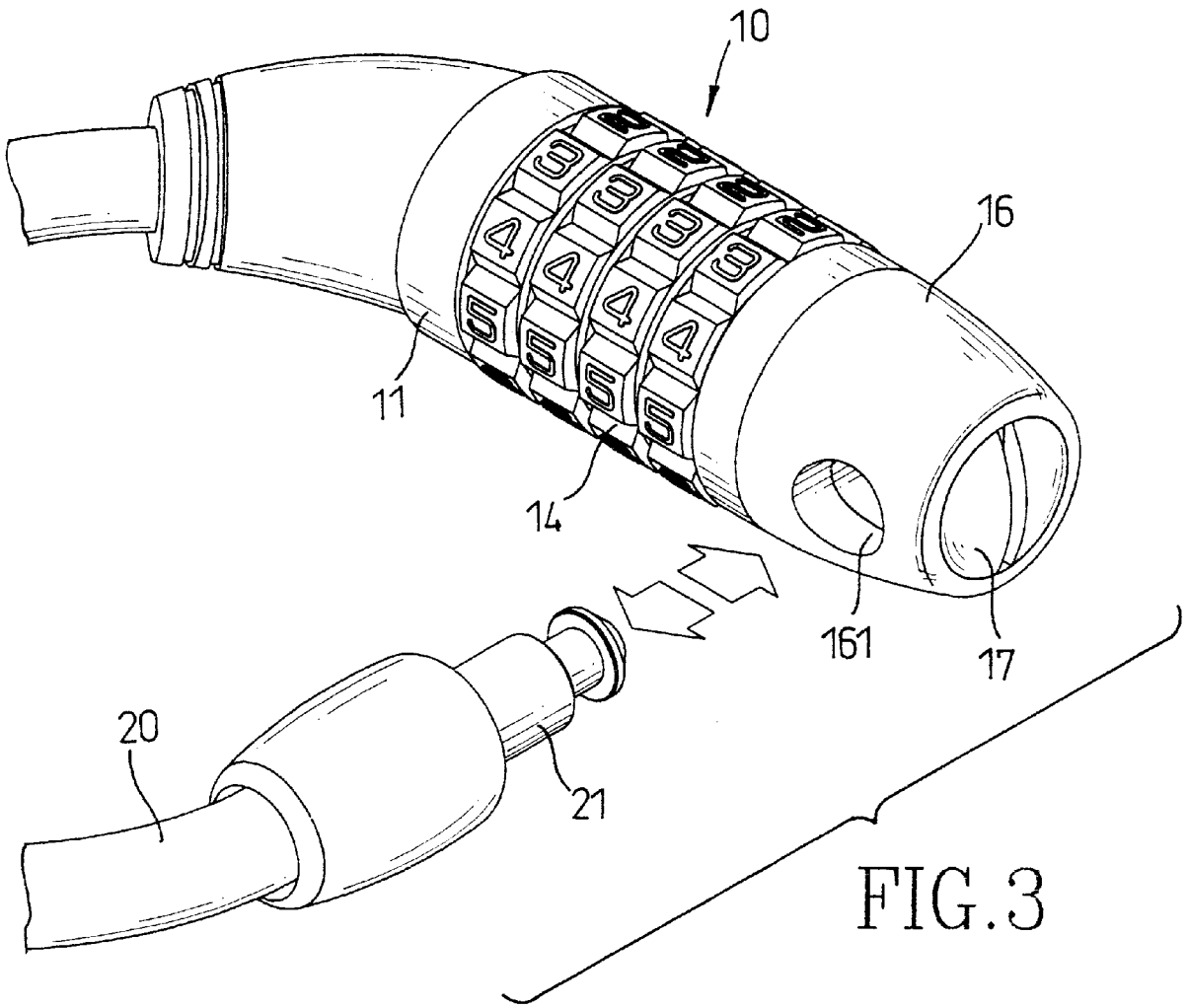
FIG. 3 is a perspective view of the combination lock in FIG. 1 with the stub released from the body.

With reference to FIGS. 2 and 3, when the combination lock is assembled, the inner spring (12) is inserted inside the combination ring shaft (111), and the outer spring (13) is mounted around the combination ring shaft (111). Each of the combination ring assemblies (14) is mounted on the combination ring shaft (111) by sequentially mounting the abutting ring (143), the hairspring (144), the positioning ring (142) and the combination ring (141). The locking bar (15) is into the combination ring shaft (111) with one end abutting the inner spring (12) and the opposite end with the knife-edge latch (152) outside the combination ring shaft (111), and the teeth (151) in the slot (112). The plug (17) is inserted into the cover (16) with the knife-edge latch (152) on the locking bar (15) extending into the chamber (171) of the plug (17). The locking bar (15), the cover (16) and the plug (17) are connected together by inserting the pin (162)

through the pin hole (163), the guiding slot (174) and into the pin slot (153).

Figure 4:
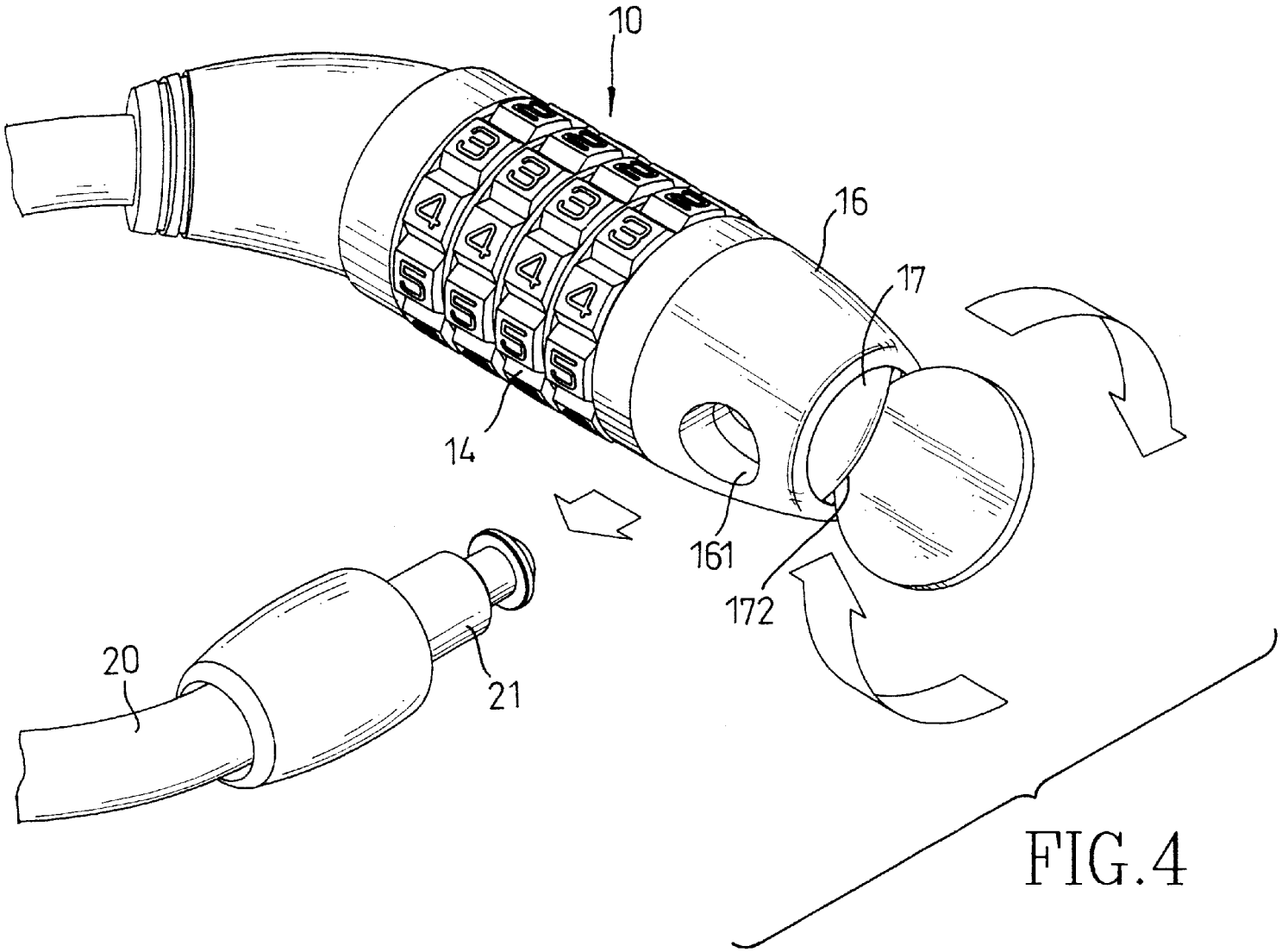
FIG. 4 is an operational, perspective view of the combination lock in FIG. 1 when changing the combination.
Figure 5:
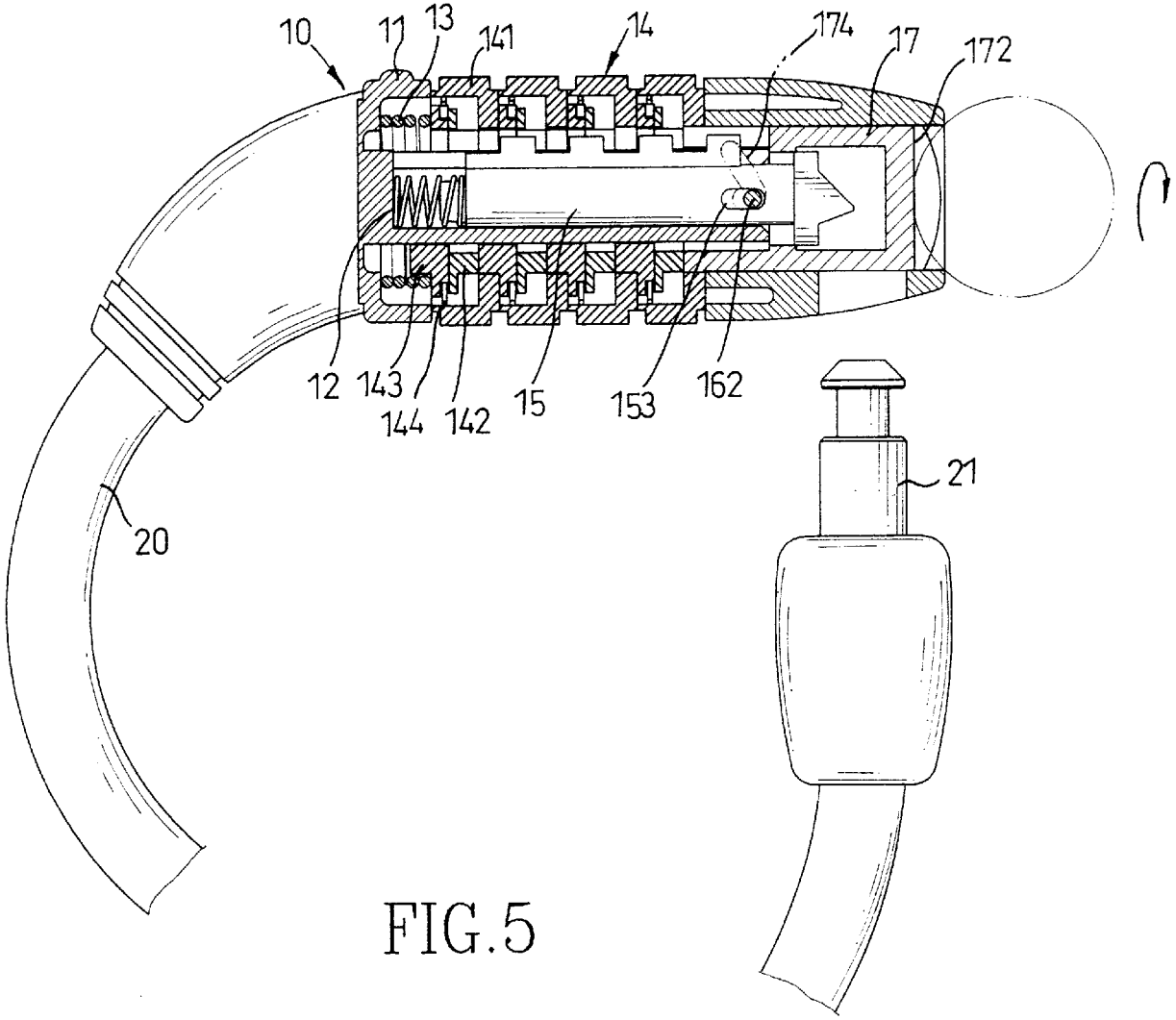
FIG. 5 is an operational top plan view in partial section of the combination lock in FIG. 1 when changing the combination number.

With reference to FIGS. 4 and 5, when the combination of the combination lock is changed, the locking stub (21) and the body (10) must be released and the locking stub (21) removed from the body (10). A tool such as a coin in this preferred embodiment is inserted into the screw slot (172), and by turning the coin, the plug (17) pushes the positioning rings (142) and separates them from the combination rings (141). When the plug (17) turns, the first radial through hole (161) in the cover (16) and the second radial through hole (173) in the plug (17) no longer communicate with each other. The first through radial hole (161) in the cover (16) is closed by the periphery of the plug (17) to keep the locking stub (21) or dust from entering the chamber. Because the combination rings (141) are separated from the positioning ring (142), a user may reset the combination to a desired number. After resetting the combination, the coin is turned to return the plug to the original position with the first through radial hole (161) and the second radial through hole (173) aligned with each other. The positioning rings (142) engage the combination rings (141) automatically by the force applied by the inner and outer springs (12, 13).

Figure 6:
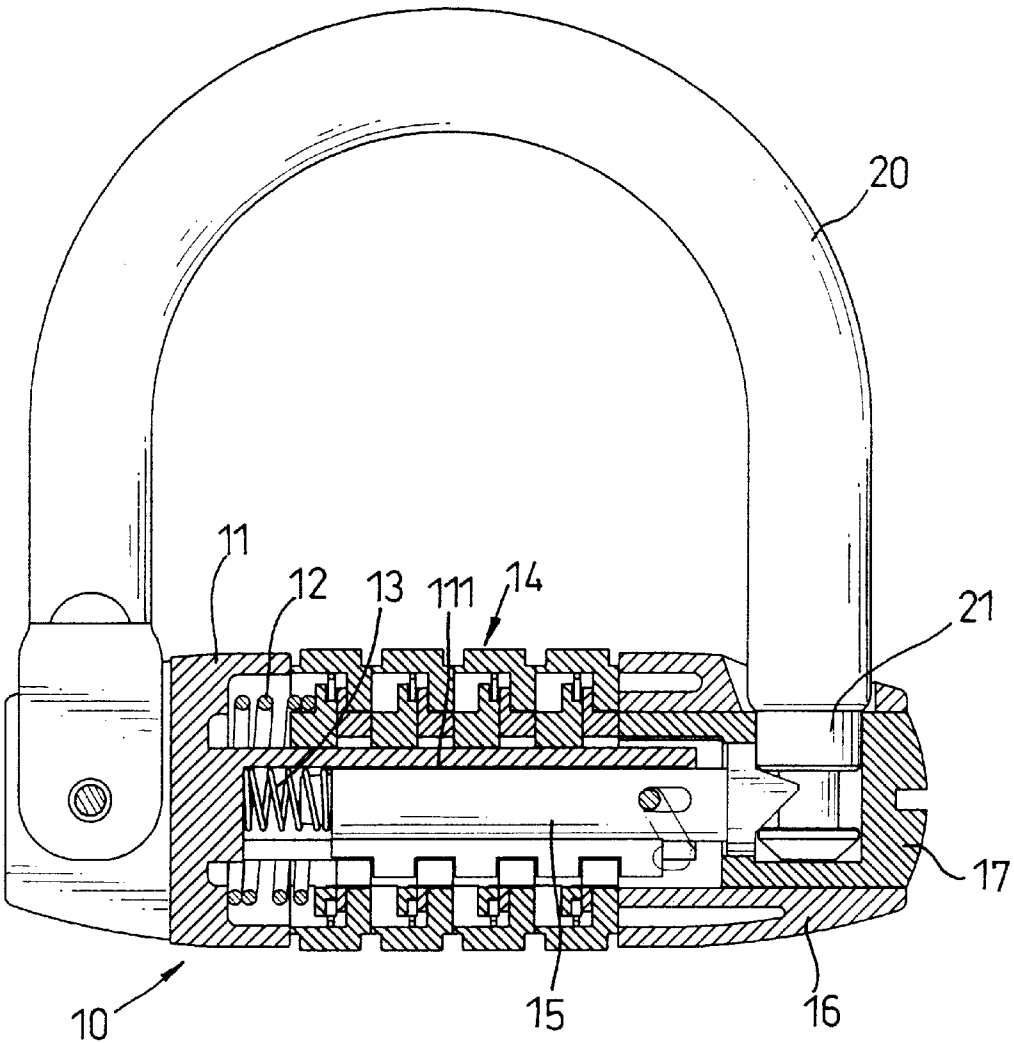
FIG. 6 is top plan view of another preferred embodiment of the combination lock in accordance with the present invention.

With reference to FIG. 6, in another preferred embodiment, the cable (20) of the previous embodiment is replaced with a U-bar (20). The remaining components are unchanged and operate in the same manner as the previous embodiment. Thus further description is omitted in order to avoid excessive description.

From the foregoing description, the combination lock in accordance with the present invention has the following advantages:

1. simplified structure: The combination lock has a simplified structure which is easy and convenient to manufacture and assemble.
2. avoids inadvertent changing of the combination: When the combination is changed, the locking stub (21) must be removed from the body and a tool such as a coin is needed. This keeps the combination from being accidentally changed with the combination lock in a locked condition.
3. prevent dust from entering the body (10): When the combination is changed, the first radial through hole (161) is closed thus preventing dust from entering the body (10).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination lock comprising:

a cable connector having a hollow combination ring shaft extending from the cable connector, and the combination ring shaft having a longitudinal slot defined in the combination ring shaft;

an inner spring inserted in the combination ring shaft;

an outer spring mounted around the combination ring shaft;

multiple combination rings with an outer face and inner surface mounted around the combination ring shaft, and each of the combination rings having numbers on the outer face and detents corresponding to the numbers on the inner surface;

multiple positioning rings mounted around the combination ring shaft and each of the multiple positioning rings mounted concentric with and inserted into the corresponding combination ring, and the positioning ring having a protuberance configured to be received in any one of the detents;

multiple abutting rings mounted around the combination ring shaft and each of the multiple abutting rings mounted concentric with the corresponding positioning ring;

a locking bar having multiple teeth and a knife-edge latch; wherein the locking bar is inserted in the combination ring shaft with the teeth received in the slot;

a cover having a first radial through hole;

a cylindrical plug having a chamber, an open end, a closed end and a second radial through hole communicating with the chamber; wherein the plug is received in the cover with the knife-edge latch in the chamber; and a cable having two ends with the cable connector attached to one end and a locking stub attached to the other end; wherein the locking stub is able to enter the chamber through the first radial through hole and the second radial through hole and abut the knife-edge latch; wherein the improvements comprise:

a pin hole defined in the cover, a guide slot defined in the plug, a pin slot defined in the locking bar and a pin extending through the pin hole, the guide slot and the pin slot to guide the locking bar to control the engagement between the multiple combination rings and the multiple positioning rings by turning the plug.

2. The combination lock as claimed in claim l, wherein a screw slot is defined in the closed end of the plug to allow a tool to be received into the slot to turn the plug.

3. A combination lock comprising:

a cable connector having a hollow combination ring shaft extending from the cable connector, and the combination ring shaft having a longitudinal slot defined in the combination ring shaft;

an inner spring inserted in the combination ring shaft;

an outer spring mounted around the combination ring shaft;

multiple combination rings with an outer face and an inner surface mounted around the combination ring shaft, and each of the combination rings having numbers on the outer face and detents on the inner surface corresponding to the numbers;

multiple positioning rings disposed around the combination ring shaft and each of the multiple positioning rings mounted concentric with and inserted into the corresponding combination ring, and the positioning ring having a protuberance configured to be received in any one of the detents;

multiple abutting rings mounted around the combination ring shaft and each of the multiple abutting rings concentric with the corresponding positioning ring;

a locking bar having multiple teeth and a knife-edge latch; wherein the locking bar is inserted into the combination ring shaft with the teeth received in the slot;

a cover having a first radial through hole;

a cylindrical plug having a chamber and a second radial through hole communicating with the chamber; wherein the plug is received in the cover with the knife-edge latch in the chamber; and a U-bar with two ends, and the cable connector mounted on one end and a locking stub on the other; wherein the locking stub is able to enter the chamber through the first radial through hole and the second radial through hole and abut to the knife-edge latch; wherein the improvements comprise:

a pin hole defined in the cover, a guide slot defined in the plug, a pin slot defined in the locking bar and a pin extending through the pin hole, the guide slot and the pin slot to guide the locking bar to control the engagement between the multiple combination rings and the multiple positioning rings by turning the plug.

4. The combination lock as claimed in claim 3, wherein a screw slot is defined in the closed end of the plug to allow a tool to be received in the slot to turn the plug.

* * * * *